US006782948B2

(12) United States Patent
Echols et al.

(10) Patent No.: US 6,782,948 B2
(45) Date of Patent: Aug. 31, 2004

(54) REMOTELY OPERATED MULTI-ZONE PACKING SYSTEM

(75) Inventors: Ralph Echols, Dallas, TX (US); Phillip Thomas, The Colony, TX (US); Travis Hailey, Sugar Land, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/235,333

(22) Filed: Sep. 5, 2002

(65) Prior Publication Data

US 2003/0047311 A1 Mar. 13, 2003

Related U.S. Application Data

(62) Division of application No. 09/767,975, filed on Jan. 23, 2001, now Pat. No. 6,488,082.

(51) Int. Cl.[7] ..... E21B 34/06; E21B 43/04; E21B 43/267

(52) U.S. Cl. ..... 166/278; 166/51; 166/66.6; 166/66.7; 166/191; 166/177.5; 166/280.1; 166/313; 166/318; 166/319; 166/332.1; 166/373

(58) Field of Search ..... 166/51, 66.6, 66.7, 166/191, 177.5, 278, 280, 313, 316, 318, 319, 332.1, 373, 374, 375, 280.1

(56) References Cited

U.S. PATENT DOCUMENTS

| | | | | | |
|---|---|---|---|---|---|
| 3,741,300 | A | * | 6/1973 | Wolff et al. | 166/184 |
| 5,005,649 | A | * | 4/1991 | Smith et al. | 166/308 |
| 5,975,205 | A | * | 11/1999 | Carisella | 166/278 |
| 6,202,742 | B1 | * | 3/2001 | Echols | 166/51 |
| 6,220,353 | B1 | * | 4/2001 | Foster et al. | 166/278 |
| 6,253,857 | B1 | * | 7/2001 | Gano | 166/386 |
| 6,257,338 | B1 | * | 7/2001 | Kilgore | 166/387 |
| 6,298,916 | B1 | * | 10/2001 | Tibbles et al. | 166/278 |
| 6,311,772 | B1 | * | 11/2001 | Myhre et al. | 166/278 |
| 6,384,738 | B1 | * | 5/2002 | Carstensen et al. | 340/854.3 |
| 6,543,538 | B2 | * | 4/2003 | Tolman et al. | 166/278 |

* cited by examiner

*Primary Examiner*—George Suchfield
(74) *Attorney, Agent, or Firm*—David W. Carstens

(57) ABSTRACT

A multi-zone packing system having unique features that allow for remote operation, thereby eliminating the need to raise and lower a work string and crossover tool to various zones of interest during a frac pack, gravel pack or related completion procedure. The squeeze pack system has a crossover tool or port collocated with each zone of interest and remotely operated closing devices to allow for the setting of each packer and the packing job to be performed with minimal or no movement of the work string.

30 Claims, 7 Drawing Sheets

REMOTELY OPERATED MULTI-ZONE PACKING SYSTEM

This application is a divisional of application Ser. No. 09/767,975 file Jan. 23, 2001, now U.S. Pat. No. 6,488,082.

BACKGROUND OF THE INVENTION

1. Technical Field

The present invention relates to a remotely operated multi-zone packing system used in multi-zone gravel pack, frac pack, and similar applications in oil field wells. Specifically, the present invention allows for remote operation of gravel pack, frac pack, or similar assemblies in multi-zone applications, thus eliminating the requirement to physically relocate a work string to each zone of interest to accomplish various phases of the completion.

2. Description of Related Art

Gravel pack assemblies and frac pack assemblies are commonly used in oil field well completions. A frac pack assembly is used to stimulate well production by using liquid under high pressure pumped down a well to fracture the reservoir rock adjacent to the wellbore. Propping agents suspended in the high-pressure fluids (in hydraulic fracturing) are used to keep the fractures open, thus facilitating increased flow rates into the wellbore. Gravel pack completions are commonly used for unconsolidated reservoirs for sand control. Gravel packs can be used in open-hole completions or inside-casing applications. An example of a typical gravel pack application involves reaming out a cavity in the reservoir and then filling the well with sorted, loose sand (referred to in the industry as gravel). This gravel pack provides a packed sand layer in the wellbore and next to the surrounding reservoir producing formation, thus restricting formation sand migration. A slotted or screen liner is run in the gravel pack which allows the production fluids to enter the production tubing while filtering out the surrounding gravel.

A typical single-zone gravel pack completion is illustrated in FIG. 1. FIG. 1 is a schematic cutaway representation showing a perforated wellbore casing 2 with perforations 12 shown extending into a single zone of interest 10. Within the wellbore casing 2 a tube 4 has been placed on which is attached a screen 6. The gravel 8 is shown packed into the perforations 12 in the zone of interest 10 and surrounding the screen 6. The gravel 8 is an effective filter of formation fluids, because the formation sand, which would otherwise flow with the production fluid, is largely trapped at the interface with the gravel 8.

One specific type of gravel pack procedure is called a squeeze gravel pack. The squeeze gravel pack method uses high pressure to "squeeze" the carrier fluid into the formation, thereby placing gravel 8 in the perforation tunnels 12 of a completed well and the screen/casing annulus. The frac pack method is very similar, except the "squeeze" is carried out at even higher pressures with more viscous fluid in order to fracture the reservoir rock. Consequently, the down-hole assembly used for these two procedures is frequently the same, and the procedures will be discussed as examples interchangeably in this disclosure.

A typical gravel pack or frac pack assembly is presently run into the well on a work string. The work string is commonly a length of drill pipe normally removed from the well once the packing job is complete. The work string assembly contains a means for setting the packer and a crossover tool to redirect the treatment from within the work string into the formation. This is illustrated by FIG. 2, which shows a schematic cutaway of a basic frac pack assembly for a single zone of interest 210 application. At the upper portion of the assembly the work string is a single tube or pipe 214 (which is also referred to herein as the inner tubing). Further down the assembly this single tube 214 is attached to and enclosed by a middle concentric tube 216. The now inner tube 214 and middle tube 216 are integral to the work string and can be moved vertically through the wellbore annulus 202 by manipulation at the rig level. The middle tube 216 is initially attached to or pinned to an outer concentric tube 204 when the assembly is landed in the well. Immediately above the point where the middle tube 216 and the outer 204 begin to interface concentrically are seal points 218, 230, providing pressure seals between the middle concentric tube 216 and the outer concentric tube 204. Once the assembly is landed and set in place, the temporary attachment between the middle tube 216 and the outer tube 204 can be broken, for example by applying tension to a shear pin by pulling the middle tubing 216 upward. The seal points 218, 230 provide pressure isolation between the middle tubing 216 and the outer tubing 204 even as the work string is moved up and down in the assembly.

Attached to the outer tubing 204 is a hydraulic set packer 220. When "set," a procedure that will be described momentarily, the hydraulic set packer 220 provides a complete seal between the outer tubing 204 and the wellbore casing 202. Below the hydraulic set packer is a fluid crossover port 240, formed by passages through the inner tubing 214 and the concentric middle tubing 216, which allows fluid to crossover from the inner tubing 214 through the concentric middle tubing 216 without coming into physical contact with any fluid that may be passing through the annulus between the inner tubing 214 and the concentric middle tubing 216. A gravel pack port 224, which is opened and closed with a closing sleeve 226, which is operated by a shifting tool (not shown), provides communication for fluid exiting the crossover port 240 into the wellbore annulus 202. This gravel pack port 224, although shown in the open position, may be initially in the closed position with the closing sleeve 226 sealing the port 224 when the assembly is landed in the well. In the closed position, fluid transported down the inner tubing 214 is diverted by a plug 236, passes through the crossover port 240, and is isolated between the hydraulic set packer 220 and a seal 230 located below the port 224. Thus, pressure can be built up inside this isolated segment of the outer tubing 204. The packer 220 is hydraulically actuated or "set" by applying fluid pressure until the outer tubing 204 is pressure isolated by the packer's 220 seals within the wellbore annulus 202.

After the packer 220 is set, the gravel packing or frac packing job can be initiated by opening the gravel pack port 224 by shifting open the closing sleeve 226. This is typically accomplished by physically manipulating the closing sleeve 226 with a shifting tool (not shown) attached to the exterior of the middle tubing 216 by raising or lowering the work string (which consists of the inner tubing 214, the middle tubing 216, and all integral components shown in FIG. 2). Once the closing sleeve 226 opens the port 224, the proppant for the gravel pack or frac pack completion is pumped down the inner tubing 214, through the crossover port 240, out the gravel pack port 224, and into the wellbore annulus 202, as indicated by flow arrows 250 in FIG. 2. Below the closing sleeve 226 and gravel pack port 224, the outer tubing 204 comprises a screen or slotted liner 206, similar to the screen 6 illustrated in FIG. 1. Therefore, during the "frac job" the proppant is forced into the perforations 212 of the wellbore casing 202 and begins to fill the cavity between the screen 206 and the wellbore casing 202. The carrier fluid 250 for the gravel, after being filtered by the screen 206, may be circulated through the annulus between the inner tubing 214 and the concentric middle tubing 216, which has an open end 232 inside the screen 206 in a single zone of interest application. The fluid 250 goes past a ball 234 near the bottom opening 232 of the middle tubing 216, which acts as a check valve preventing fluids from back flowing from the annulus between the inner tubing 214 and the concentric middle tubing 216 back into the screen. The circulation of the carrier fluid exits through a port 238 above the seal point 218.

The gravel pack procedure becomes more complex when it is necessary to accomplish a frac pack or gravel pack completion on multiple zones of interest within the same wellbore. FIG. 3 illustrates a schematic cutaway of a typical prior art multi-zone frac pack assembly used for this purpose. FIG. 3 shows two zones of interest 310, 311 isolated by hydraulic set packers 320, 321, 322. Packers 321 that separate zones of interest 310, 311 are typically called isolation packers, while the packer 322 which is set below the last zone of interest in the wellbore is known as a sump packer and is set before landing the gravel pack assembly. Common to each zone of interest 310, 311 on the multi-zone assembly is a gravel pack port 324, 325 with associated closing sleeve 326, 327 and a screen 306, 307. The screens 306, 307 are placed opposite each zone of interest 310, 311. As with the single zone of interest assembly illustrated by FIG. 2, the multiple zone assembly comprises inner tubing 314 and middle tubing 316, which are attached above the top packer 320. Outer tubing 304 is shown which is initially fixed in position relative to the other concentric tubes (work string) when landing in the well. Although the upper gravel pack port 324 is shown closed while the lower gravel pack port 325 is shown open in FIG. 3 for illustrative purposes, all of the gravel pack ports 324, 325 are initially in the closed position when the assembly is landed in the well.

To begin the frac pack or gravel pack completion, each of the isolation packers 320, 321 must be set. This is accomplished by starting at the lowest zone 311 to be treated with the crossover tool 340 in the position illustrated by FIG. 3. Since the gravel pack port 325 is initially closed, fluid 350 pumped down the inner tubing 314 is diverted by a plug 336 and flows through the crossover port 340 into the outer tubing 304, where it is contained between seals 331 and the packer 321. Increasing the fluid pressure thereby actuates or "sets" the hydraulic set packer 321. The crossover port 340 is then raised to the next zone 310 by lifting the entire work string (comprising both the inner tubing 314 and the middle tubing 316) in order to set the next packer 320 by the same method. A series of bore seals 317, 318, 319 ensure a proper pressure seal between the middle tubing 316 and the outer tubing 304 while the work string is manipulated.

Once all of the packers 320, 321 have been set, the crossover port 340 is returned to the lowest zone of interest 311 in order to begin the packing stage. Again, this is accomplished by physically lowering the entire work string. All of the gravel pack ports 324, 325 are now in the open position by virtue of, for example, the actuation of a closing sleeve 326, 327 by a shifting tool (not shown). With the crossover port 340 located in the lowest zone of interest 311, proppant 350 is forced from the inner tubing 314, through the crossover port 340, out the open port 325, and into the wellbore annulus 302. The return fluid 350 "circulates" by traveling through (and is filtered by) the screen 307, into the open end 332 of the middle tubing 316, past the ball 334 and plug 336, through the annulus between the inner tubing 314 and the concentric middle tubing 316, and out the exit port 338, just as in the single zone assembly shown in FIG. 2. Once the packing job is completed in the lowest zone of interest 311, the crossover port 340 is moved to the next zone of interest 310 (by raising the work string) to accomplish a similar procedure, and so on until all zones are completed.

Although FIG. 3 shows only two zones of interest 310, 311, the procedure is the same, and the fixed assembly components (packers, gravel ports, closing sleeves, and screens) are simply duplicated, regardless of the number of zones treated during the packing job. Isolation packers between the zones are set separately by pulling up the work string, and then a packing job is completed on each zone separately by physically placing the crossover port 340 within the zone to be treated and opening the adjacent gravel pack port.

The physical manipulation of the work string up and down through the outer tubing 304 and wellbore casing 302 poses several practical problems with the prior art multi-zone assemblies. The proppants mixed in the fluids 350 used in these applications are extremely abrasive and erosive. The tubing 314, 316 illustrated in FIG. 3 is, of course, not a continuous piece of tubing. Rather, the tubing 314, 316 is made up of individual segments with connections and seals located at the intersection of each segment. These seals are subject to wearing as the work string is moved up and down in such an erosive environment. Consequently, the seals are prone to failure thus compromising the integrity of the assembly. There is also the potential that the work string might get stuck while being moved up and down to accomplish various phases of the completion. The need to physically manipulate the crossover port 340 up and down to the various zones of interest, each time taking steps to insure proper placement of the port 340, is also an involved procedure requiring additional rig time and, consequently, additional cost to the completion job.

A need exists, therefore, for a multi-zone pack assembly that can be remotely activated without the necessity of physically raising and lowering the work string and crossover tool to each zone of interest. Such invention would greatly reduce the wear on the tubing seals and eliminate the potential of the work string getting stuck within the outer tubing during the packing job. Such invention could also save time and completion related expenses by simplifying the steps required to perform each stage of the completion.

SUMMARY OF THE INVENTION

The present invention relates to an improved multi-zone gravel pack, frac pack and like assemblies that operate without the necessity of raising and lowering a working string and crossover tool to various zones of interest. The invention uses the unique design of having a crossover tool on the working string collocated at every zone of interest combined with remotely activated closing tools.

One embodiment of the invention discloses a circulation valve, which allows for carrier fluid to either circulate after passing through the screen or flow through from a lower portion of the assembly, or be "reverse circulated" back up the workstring, and a remotely activated crossover port at each zone of interest. The closing sleeve on the gravel pack port allowing access to the wellbore annulus is opened and closed through use of traditional closing tools and minor manipulations of the work string. However, the work string does not need to be raised and lowered as between zones of interest. Therefore, the wear and tear on the work string is greatly reduced and the time required to perform the setting of each isolation packer as well as the gravel pack completion in each zone is reduced.

Another embodiment of the invention requires no movement of the work string relative to the outer tubing. Again, in the circulation embodiment, there is a crossover tool collocated at every zone of interest. Rather than using a closing sleeve on the gravel pack port and a circulation valve, the second embodiment uses an iris valve or other similar means to divert flow within the washpipe and a remotely actuated closing sleeve at the gravel pack port.

The invention is versatile and can be tailored to meet the requirements of each specific well completion. By eliminating the need to move the work string and single crossover tool to each zone of interest in order to set each individual packer and later perform the gravel pack job for each zone, this invention greatly reduces the wear and tear on the work string seals and eliminates the possibility that the work string might become stuck during physical manipulation. Further, by allowing the stages of a multi-zone packing job to be accomplished simultaneously, and by eliminating the time required to raise and lower the working string, this invention is a great improvement over the prior art in efficiency and cost effectiveness.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE DRAWINGS

Figure 1:
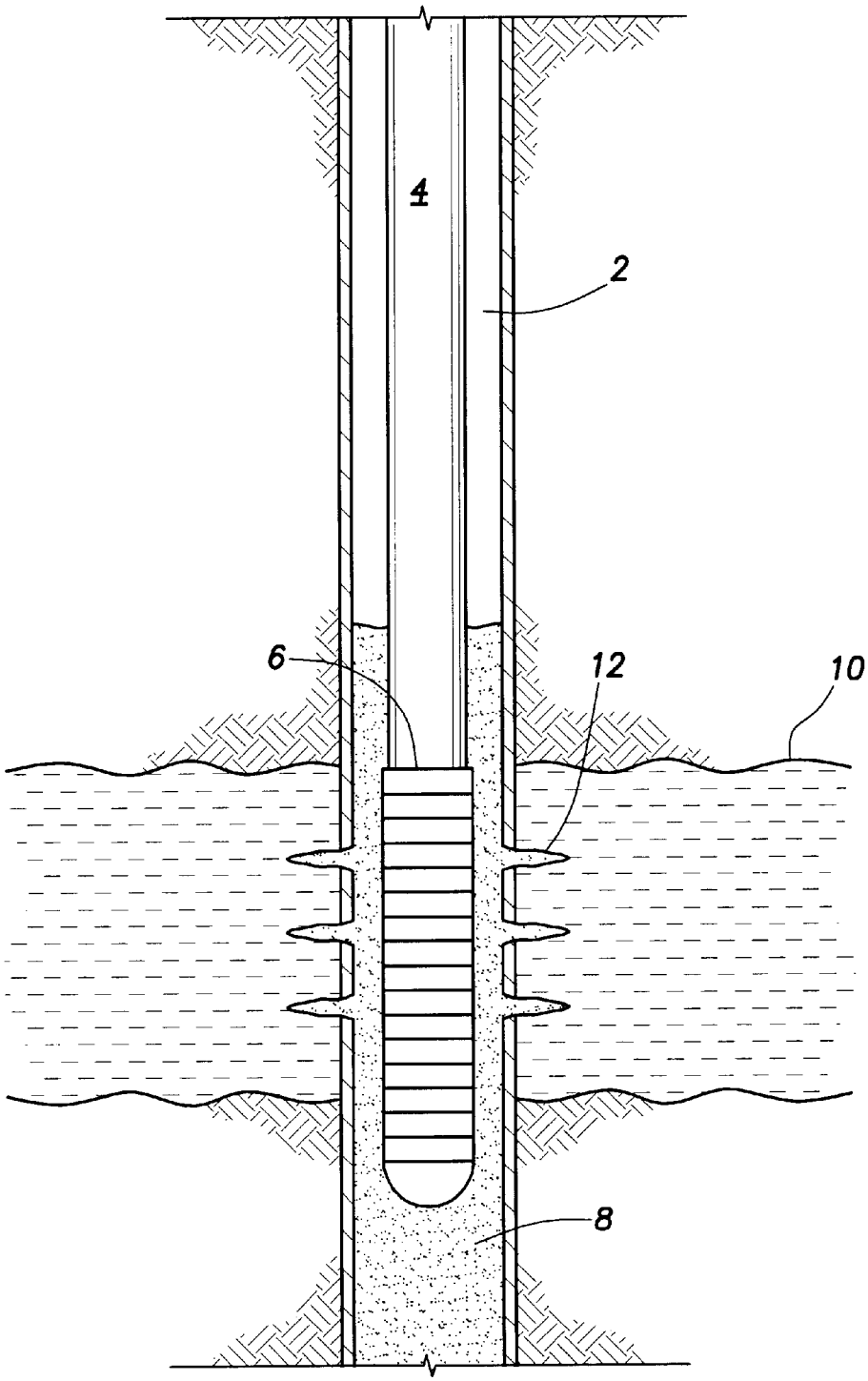
FIG. 1 (PRIOR ART)
FIG. 1 is a schematic representation of a prior art gravel pack completion in a single zone of interest application.
Figure 2:
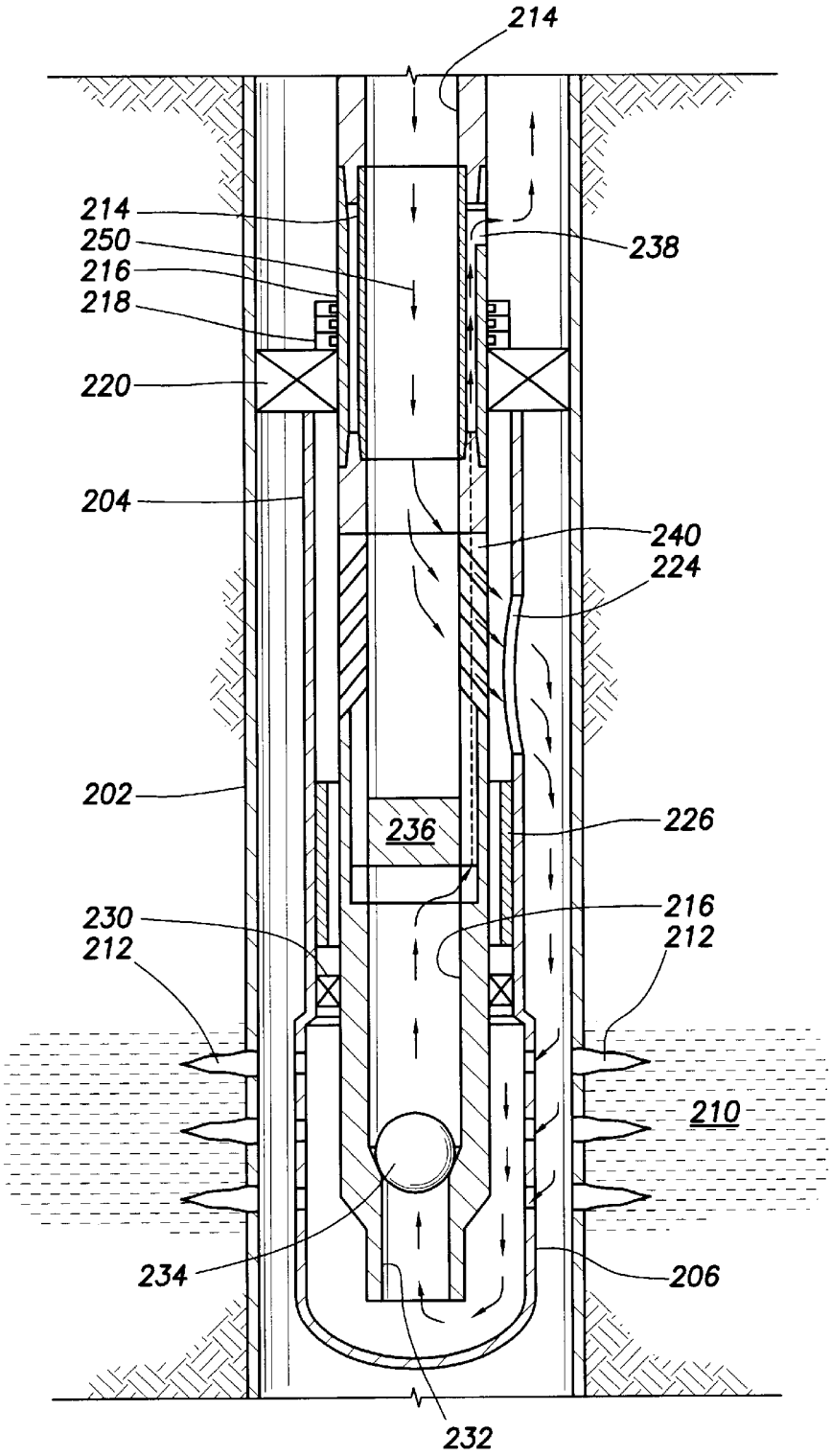
FIG.2 (PRIOR ART)
FIG. 2 is a cross sectional schematic of a prior art single zone squeeze pack assembly.
Figure 3:
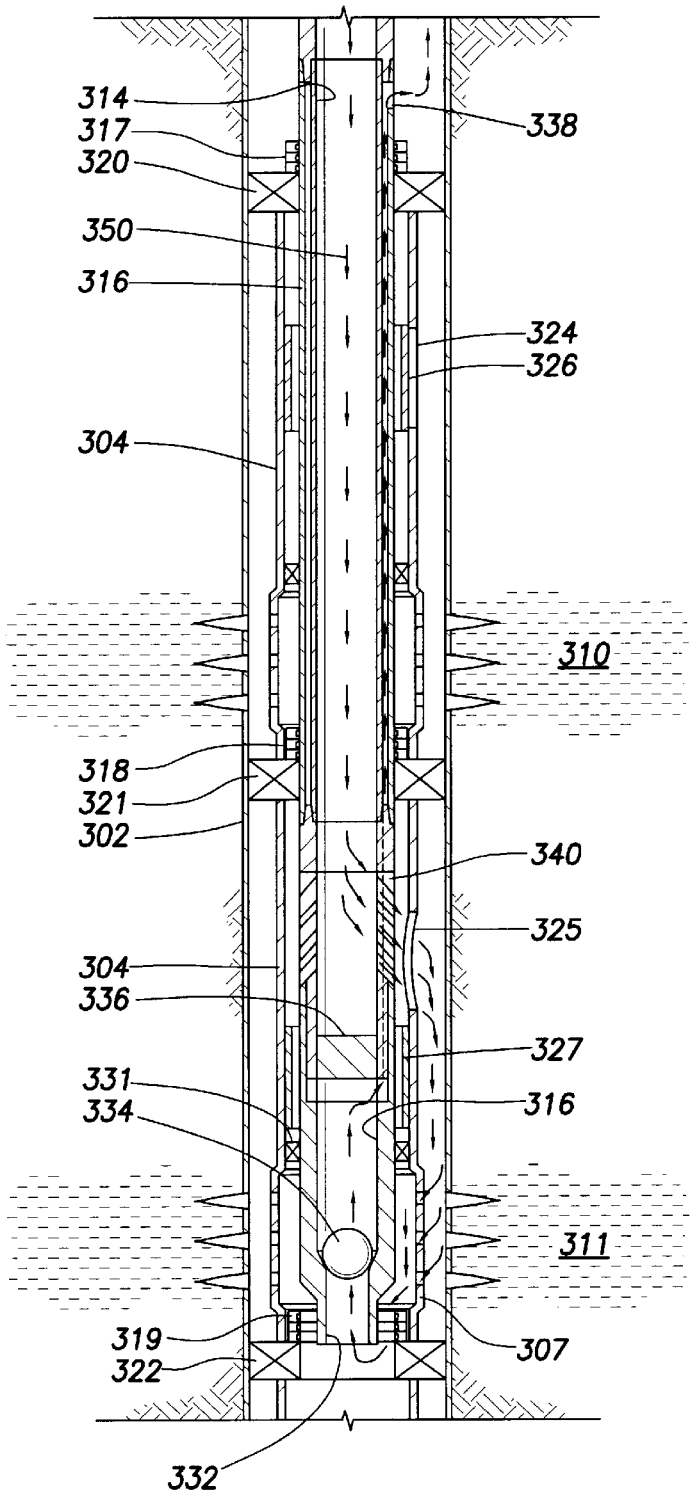
FIG.3 (PRIOR ART)
FIG. 3 is a cross sectional schematic of a prior art multi-zone squeeze pack assembly.
Figure 4:
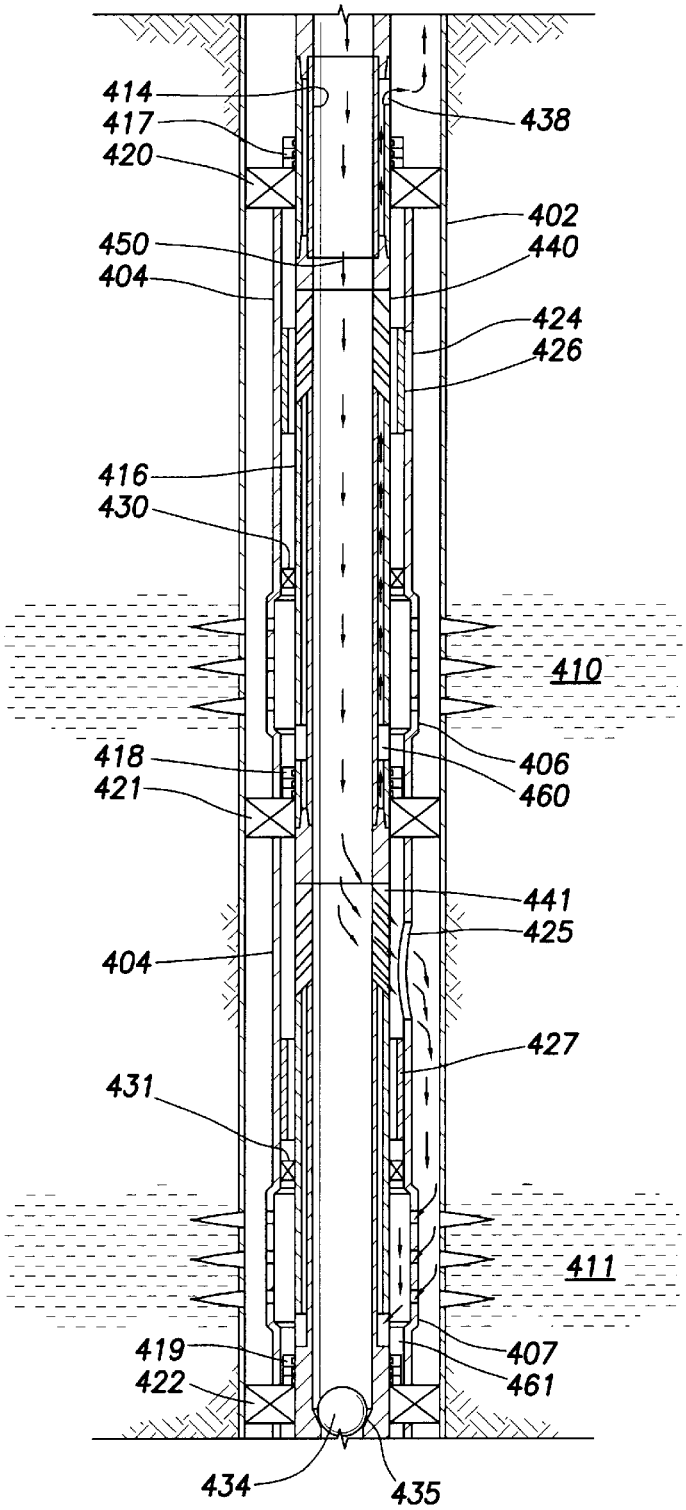
FIG. 4 is a cross sectional schematic of an embodiment of the present invention incorporating a remotely activated crossover valve.

FIG. 4 illustrates one embodiment of the present invention showing two zones of interest 410, 411. As with the prior art assembly shown in FIG. 3, these zones of interest 410, 411 are isolated by packers 420, 421, 422. Between each packer 420, 421, 422 there are three lengths of concentric tubing. FIG. 4 shows an inner tubing string 414, a middle tubing string 416, and an outer tubing 404. The inner tubing 414 and middle tubing 416 are, as with the prior art method of FIG. 3, connected together and integral to the work string. Proppant 450 flows from the top of the assembly down the inner tubing 414 for use in both setting the packers 420, 421 and performing the frac or gravel pack. The filtered carrier fluid is recirculated through the assembly via the middle tubing 416.

Referring to the portion of the assembly associated with the upper zone of interest 410, a crossover port 440 is provided to allow flow of the fluids 450 from the inner tubing 414 past the middle tubing 416 and inside the outer tubing 404. The outer tubing has a gravel pack port 424, which is initially in the closed position when the assembly is landed in the well, and below the port 424 a seal 430 isolating a segment of the outer tubing 404 between the packer 420 and the seal 430. Therefore, when fluids 450 go through the crossover port 440 and into the outer tubing 404, the hydraulic set packer 420 can be set as similarly described when discussing prior art methods.

FIG. 4 also shows a screen 406, 407 opposite each zone of interest and the same basic three concentric tube arrangement shown in the prior art multi-zone system illustrated in FIG. 3. The invention illustrated in FIG. 4 contains, however, two unique features that eliminate the need to raise and lower a crossover tool into each zone to perform setting the packer and, later, to perform the packing job for each zone. First, FIG. 4 shows that a crossover port 440, 441 is located adjacent to a gravel pack port 424, 425 at every zone 410, 411. This crossover port 440, 441 is remotely activated to open and close. Closing the crossover port 440, 441 closes the communication of fluids 450 between the inner tubing 414 and the outer tubing 404, while opening the crossover port 440, 441 permits fluids 450 to flow from the inner tubing 414, across the middle tubing 416, and into the outer tubing 404. Consequently, a crossover of fluids 450 into any specific zone 410, 411 can be accomplished by selecting a specific crossover tool to open while closing the other crossover tools. The second unique feature is circulation valves 460, 461 located between the inner tubing 414 and middle tubing 416 below each screen 406, 407. These three-way circulation valves 460, 461 allow either communication of fluids 450 to the annulus between the inner tubing 414 and middle tubing 416 after passing through the crossover ports 440, 441, gravel pack ports 424, 425, and screens 406, 406, or "pass through" communication to or from below the valves 460, 461 entirely through the annulus between the inner tubing 414 and the middle 416, or "pass through" communication to or from below contained entirely within the inner tubing 414, depending on the position selected. As with the crossover ports 440, 441, the circulation valves 460, 461 are remotely activated. The remote activation for both the crossover ports 440, 441 and the circulation valves 460, 461 could be accomplished by either a hard wire arrangement or wireless communication.

In practice, the assembly illustrated by FIG. 4 is made up at the surface and run into the hole in one trip with the closing sleeves 426, 427 initially in a position sealing off the gravel pack port 424, 425, as illustrated for the upper sleeve 426 in FIG. 4. After the assembly is run to the proper depth and landed, a ball 434 is dropped from the rig level to set a packer 420 at the top of the completion, such as a Versa Trieve packer. This ball seats at a hydraulic setting tool (not shown) in order to actuate the packer 420. The ball 434 is then released and dropped to a tapered ball seat 435 at the bottom of the work string where it lands and seals off the work string.

The remaining isolation packers 421 can now be set. Since the bottom of the assembly is plugged by the setting ball 434 and all the gravel pack ports 424, 425 are initially closed by the closing sleeves 426, 427, the isolation packers 421 (assuming there are more than one not yet set) can all be set simultaneously with all crossovers ports 440, 441 open or sequentially by selectively operating the crossover ports 440, 441 such that only one is open at a time.

By way of example, it will be assumed that the uppermost packer 420 was not previously set as described above, but, rather, is an isolation packer located below another zone of interest not shown on FIG. 4. Under this assumption, FIG. 4 illustrates only two zones 410, 411 of interest in a multi-zone completion of three or more zones. The two illustrated isolation packers 420, 421, along with any other isolation packers in the multi-zone system, could be set simultaneously by remotely opening all the crossover ports 440, 441, with the gravel pack ports 424, 425 closed. Fluid pressure is now communicated from the inner tubing 414, through the crossover ports 440, 441, and is isolated in the outer tubing 404 between the packers 420, 421, and their respective seals 430, 431. Consequently, all of the isolation packers 420, 421 can be set simultaneously. Alternatively, each isolation packer 420, 421 could be set individually by only opening the crossover ports 440, 441 immediately below the isolation packer in question.

After all the isolation packers 420, 421 are set, the closing sleeves 426, 427 are opened in the traditional manner by lifting the work string (comprising the inner tubing 414 and outer tubing 416) sufficiently so that a shifting tool (not shown) can be raised above the sleeve and then slacked back off to the original position. As with prior art assemblies, bore seals 417, 418, 419 maintain the seal between the work string and the outer tubing 404.

Referring to the lower zone of interest 411 and its respective gravel pack port 425 (shown in the open position in FIG. 4), the gravel packing is now accomplished by opening the crossover port 441 at the lower zone 411 with all other crossover ports 440 closed. At this point all the up-well circulation valves 460 are selected for the inner-tube-only "pass through" communication position. The circulation valve 461 below the screen 407 in the first zone 411, however, is placed in the "circulate" position. Consequently, proppant laden fluid 450 flows down the inner tube 414, through the lowest crossover port 441, out the open gravel pack port 425, and performs the frac or gravel pack job in the zone of interest 411 between the two packers 420, 421. The carrier fluid 450 is then filtered through the screen 407, thus passing through the outer tubing 404. Since the circulation valve 461 has been set to communicate with the outer tubing 404, the filtered carrier fluid 450 next travels through the circulation valve 461 and is diverted up the annulus between the inner tubing 414 and the middle tubing 416. Carrier fluid 450 continues passing by all of the up-well crossover ports 440, 441, through all the up-well circulation valves 460, and will eventually exit the assembly above the upper packer 420 into the wellbore annulus 402 by way of an exit port 438.

A reverse circulation mode, used to clear away excess fluids and proppant left after packing the first zone 411, may be achieved by selecting a position for the valve 461 which closes communication with the screen 407 and opens communication between the inner tubing 414 and the annulus between the inner tube 414 and the middle tube 416. Fluids 450 may be reverse circulated by applying pressure through the port 438, which may cause flow down said annulus and back up the inner tubing 414 and workstring above.

The gravel pack for the next zone 410 is accomplished by repeating this process. It is not necessary to raise the work string to the next level, since there is a crossover port 440, 441 collocated at every zone of interest 410, 411. The crossover port 441 at the lower zone 411 is closed and the crossover port 440 at the next zone 410 is opened. The circulation valve 460 collocated with this zone 410 is moved from the flow through position to the circulate position. Since the gravel pack port 424 is now open, the packing job is accomplished as described above.

Once all of the zones of interest 410, 411 have been treated, the work string is then removed by first opening all crossover ports 440, 441 and circulation valves 460, 461. The work string is then pulled out of the hole. All closing sleeves 426, 427 are closed at this time. Next, a conventional concentric string is run into the completion including seals for isolation between zones and any other equipment required for selective production.

Figure 5:
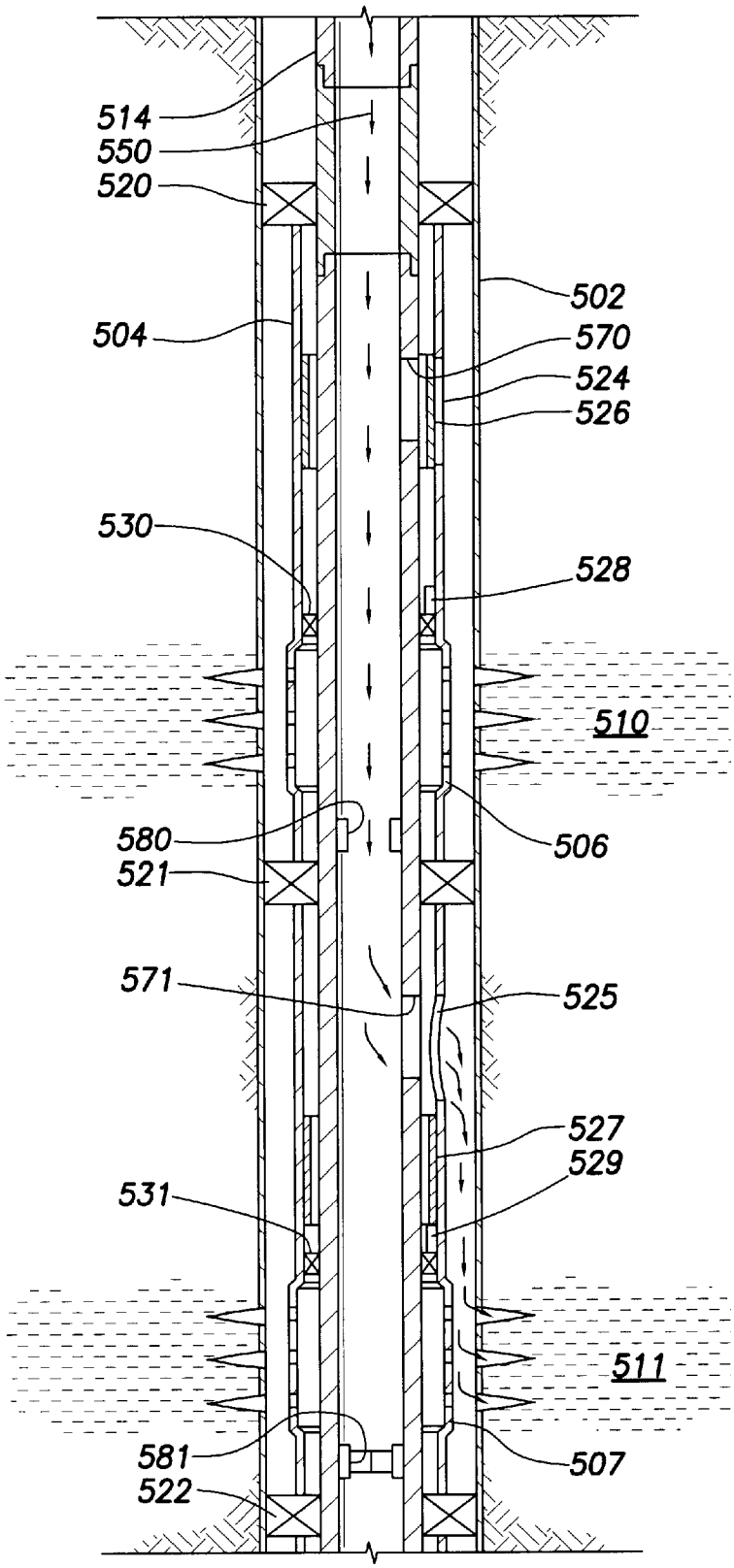
FIG. 5 is a cross sectional schematic of an embodiment of the present invention incorporating an iris plug in a non-circulation application.

Another embodiment of this invention is illustrated in FIG. 5. FIG. 5 shows a multi-zone squeeze pack assembly without circulation. This embodiment has an inner tubing string 514 and an outer tubing 504. Each zone of interest 510, 511 is isolated by packers 520, 521, 522. There is a crossover port 570, 571 at each zone of interest 510, 511 for fluid communication between the inner tubing 514 and the outer tubing 504. There is also at each zone 510, 511 a gravel pack port 524, 525 for communicating between the outer tubing 504 and the wellbore annulus 502. As with the previous embodiment, the segment of the outer tubing 504 in communication with the screen 506, 507 is separated from the segment of the outer tubing 504 in communication with the packer 520, 521 by a seal 530, 531.

Figure 6A:
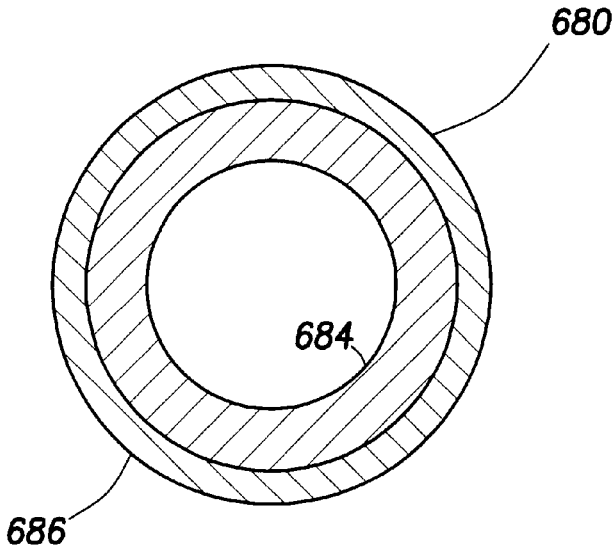
FIG. 6*a* is an overhead perspective view of an open iris plug.
Figure 6B:
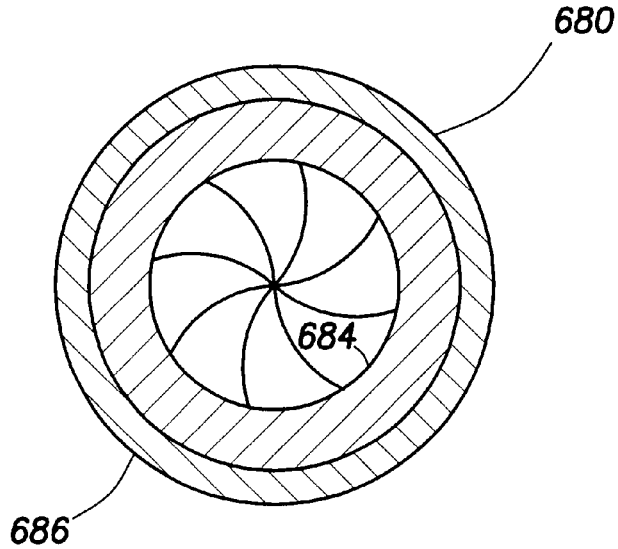
FIG. 6*b* is an overhead perspective view of a closed iris plug.

The embodiment illustrated by FIG. 5 requires no manipulation of the work string due to two unique features. First, the closing sleeves 526, 527 are remotely actuated by, for example, electrical actuators 528, 529 which are either hard wired or operate by wireless communication. Wireless means also include, but not be limited to, a hydrophone or air hammer that provides an acoustic signal that travels through the completion fluid or the tubing string. Activation could also be accomplished hydraulically through control lines from the surface. FIG. 5 shows, for illustrative purposes, the upper closing sleeve 526 in the closed position while the lower closing sleeve 527 is in the open position. Second, this embodiment utilizes unique remotely operated plug valves 580, 581 within the inner tubing 514, an example of which is illustrated in FIGS. 6*a* and 6*b*. A suitable tool might be the surface controlled reservoir analysis and management system tools made by Petroleum Engineering Services of Aberdeen, Scotland.

FIGS. 6*a* and 6*b* show a head on view of a plug 680 comprising an iris valve. FIG. 6*a* shows the valve in the open position, which would allow fluids to pass through. FIG. 6*b* shows the valve 680 in the closed position. The iris valve 680 has been closed by rotation of an interior ring 684 within an outer race 686 by an actuator contained within or attached to the plug. The plug valves 580, 581 used in the embodiment shown in FIG. 5 could also consist of a ball valve with remote actuator.

FIG. 5 illustrates how each isolation packer 520, 521 is set by first closing the gravel pack ports 524, 525 with the remotely actuated closing sleeves 526, 527. All of the isolation packers 520, 521 can be set simultaneously or each one can be set sequentially. The sequential operation is performed by closing all of the plug valves 580, 581 within the inner tubing 514. The upper hydraulic set packer 520 is then set as fluid pressure is communicated from the inner tubing 514, through the port 570 and is isolated in the outer tubing 504 between the seal 530 and the packer 520. Next, the upper iris valve 580 is opened to allow fluid communication with the segment of the inner tubing 514 in the next lowest zone 511. The packer 521 above that zone 511 could then be set by the same protocol. This procedure is followed until all of the packers 520, 521, 522 are set. Conversely, all of the packers 520, 521, 522 could be set simultaneously by closing all of the gravel pack ports 524, 525 and opening all of the iris valves 580, 581.

After the hydraulic set packers 520, 521 are set, the frac pack or gravel pack job can be accomplished in a particular zone, for example the lower zone 511, by simply opening the gravel pack port 525 at that zone. This allows the proppant laden fluid 550 to flow from the inner tubing 514, through the open port 571, out the gravel pack port 525, and into the wellbore annulus 502. This process is repeated until each zone of interest is completed. After the packing job is done, all of the sleeves 526, 527 are closed and the proppant remaining from the fluid 550 is removed by coil tubing or well flow when the iris plugs 580, 581 are all opened.

Figure 7:
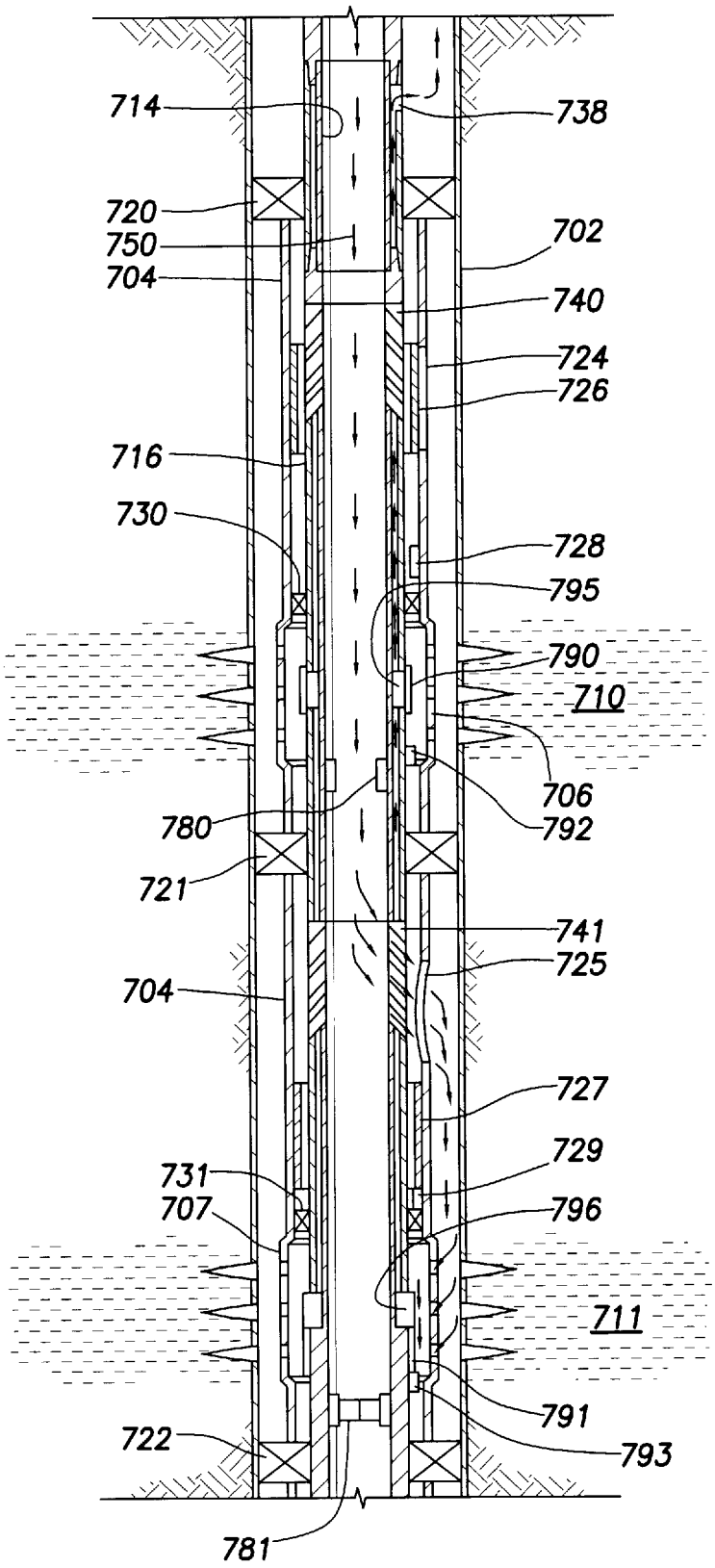
FIG. 7 is a cross sectional schematic of an embodiment of the present invention incorporating an iris plug in a circulation application.

FIG. 7 shows another embodiment of the invention using the plug valves 780, 781 and remotely activated closing sleeves 726, 727, but allowing for carrier fluid 750 recirculation. Once again, each zone of interest 710, 711 is isolated by packers 720, 721, 722. As with the embodiment shown in FIG. 4, there is an inner tubing string 714, a middle tubing string 716, and an outer tubing 704. FIG. 7 also illustrates crossover ports 740, 741 at every zone of interest 710, 711 adjacent to gravel pack ports 724, 725 and closing sleeves 726, 727. Again, the closing sleeves 726, 727 are operated by remotely controlled actuators 728, 729. However, the embodiment shown in FIG. 7, rather than having a remotely activated crossover tool that can open and close, has remotely activated inner closing sleeves 790, 791 exterior to the middle tubing 716 used to open and close the ports 795, 796 adjacent to the screens 706, 707. These inner closing sleeves 790, 791 are actuated by, for example, remotely controlled actuators 792, 793.

As with the embodiment shown in FIG. 5, the invention illustrated in FIG. 7 does not require any manipulation of the work string within the outer tubing 704. The packers 720, 721 are set either simultaneously or sequentially by the same method described above for the embodiment illustrated in FIG. 5. The isolation packers 720, 721 can also be set sequentially starting at the top of the assembly by closing the iris plug 780 immediately below the crossover port 740 collocated with the gravel pack port 724 in question and closing the said port 724 (as illustrated), thus isolating the fluid between the seal 730 and the packer 720. The process is then repeated for each additional zone.

The gravel pack is performed by starting at the bottom of the assembly and closing the lower iris plug 781 while opening all up-well plugs 780. The closing sleeve on the outer tubing 727 is opened as well as the inner closing sleeve 791 on the middle tubing 716. All other inner closing sleeves 790 are closed. Fluid flow 750 is now routed through the crossover 741, out the open gravel pack port 725 (since the seals 731 require such flow), and into the wellbore annulus 702. If return circulation is being allowed, and the carrier fluid is filtered through the screen 707 and enters the open port 796 in the middle tubing 716. The annulus between the inner tubing 714, and the middle tubing maybe permanently plugged below the bottommost zone 710, 711, or alternatively, an additional remotely activated plug or circulation valve could be placed below the port 786 on the middle tubing 716 and closed to redirect the carrier fluid upward through the annulus between the inner tubing 714 and the middle tubing 716. The carrier fluid may then flow into the annulus between the inner tubing 714 and the middle tubing 716 and circulate through to a port 738 above the inner packer.

Once the gravel pack job is completed on the lowest zone 711, the lower gravel pack port 725 is closed with the closing sleeve 727, the next iris valve 781 is closed, and the lower closing sleeve 791 is repositioned to close the lowest port 796. The two sleeves 726, 790 in the next zone of interest 710 are opened in order to repeat the gravel pack step disclosed above. After all the zones 710, 711 of interest have been completed, the work string is removed and appropriate production tubing is run into the well.

The embodiments illustrated by FIGS. 4, 5, and 7 are shown operating in two zones of interest. However, it is understood that the components of each embodiment can be repeated in order to utilize this invention in multi-zone completions having any number of zones of interest. Further, it is understood that the individual elements of each embodiment, such as remotely activated crossover tools, closing sleeves, and plug valves can be combined in numerous individual embodiments consistent with the overall goals of this invention.

Although preferred embodiments of the present invention have been described in the foregoing description and illustrated in the accompanying drawings, it will be understood that the invention is not limited to the embodiments disclosed, but is capable of numerous rearrangements, modifications, and substitutions of steps without departing from the spirit of the invention. Accordingly, the present invention is intended to encompass such rearrangements, modifications, and substitutions of steps as fall within the scope of the appended claims.

We claim:

1. A method for well completion within a well that penetrates multiple zones of interest isolated by a plurality of packers, said method comprising the steps of:

(a) setting the packers;

(b) selecting a zone of interest by remote activation of a valve or closing sleeve; and (c) pumping proppant laden fluid into the zone of interest and/or into the annulus between the wellbore casing and the outer tubing.

2. The method of claim 1 wherein step (b) is accomplished by activation of a circulation valve or valves.

3. The method of claim 1 wherein step (b) is accomplished by activation of a crossover port comprising a means to open and close by remote activation.

4. The method of claim 1 wherein step (b) is accomplished by activation of a closing sleeve.

5. The method of claim 1 wherein step (b) is accomplished by activation of a plug valve.

6. The method of claim 5 wherein said plug valve comprises an iris valve.

7. The method of claim 1 wherein step (a) is accomplished by activation of a ball valve.

8. A squeeze pack assembly having a plurality of valves and one or more packers for use in a wellbore, said assembly comprising:

a means for remote activation of a first valve for the purpose of setting a packer; and, a means for remote activation of a second valve for the purpose of performing a gravel pack in the wellbore.

9. The assembly of claim 8 wherein the remote activation means comprises hard-wired electrical communication between a control located outside the wellbore and at least one of said plurality of valves.

10. The assembly of claim 8 wherein the remote activation means comprises wireless communication between a control located outside the wellbore and at least one of said plurality of valves.

11. The assembly of claim 8 wherein at least one of said plurality of valves comprises a crossover port.

12. The assembly of claim 9 wherein at least one of said plurality of valves comprises an iris valve.

13. The assembly of claim 9 wherein at least one of said plurality of valves comprises a ball valve.

14. The assembly of claim 9 wherein at least one of said plurality of valves comprises a circulation valve.

15. The assembly of claim 8 wherein said activation means comprises a hydraulic line.

16. The assembly of claim 8 wherein said activation means comprises a hydrophone.

17. The assembly of claim 8 wherein said activation means comprises an air hammer.

18. A method of well completion within a wellbore that penetrates multiple zones of interest using a squeeze pack assembly having a plurality of valve mechanisms and a plurality of packers, said method comprising the steps of:

(a) isolating each of said zones of interest by setting at least one of said plurality of packers above and below each zone of interest;

(b) selecting a first zone of interest by remote activation of a valve mechanism; and (c) directing proppant laden fluid into the first zone of interest via an annulus between the wellbore and the squeeze pack assembly, said annulus being generally adjacent to said first zone and bounded by at least one of said plurality of packers.

19. The method of claim 18 wherein the setting of each of said plurality of packers is accomplished in sequence.

20. The method of claim 18 wherein the setting of each of said plurality of packers is accomplished concurrently.

21. The method of claim 18 wherein the setting of said plurality of packers comprises activation of a plug valve.

22. The method of claim 21 wherein said plug valve comprises a ball valve.

23. The method of claim 21 wherein said plug valve is remotely activated.

24. The method of claim 23 wherein said plug valve comprises an iris valve.

25. The method of claim 18 wherein the valve mechanism of step (b) comprises a circulation valve.

26. The method of claim 18 wherein the valve mechanism of step (b) comprises a closing sleeve.

27. The method of claim 18 wherein the valve mechanism of step (b) comprises a crossover port.

28. The method of claim 18 wherein the valve mechanism of step (b) comprises a plug valve.

29. The method of claim 24 wherein said plug valve comprises an iris valve.

30. The method of claim 18 further comprising:

(d) selecting a second zone of interest by remote activation of a second valve mechanism; and (c) pumping proppant laden fluid into the second zone of interest via a second annulus between the wellbore and the squeeze pack assembly, said second annulus being generally adjacent to said second zone and bounded by at least one of said plurality of packers.

* * * * *